United States Patent [19]

Ascoli

[11] 4,133,104

[45] Jan. 9, 1979

[54] DRY SHAVERS

[75] Inventor: Enzo Ascoli, Lausanne, Switzerland

[73] Assignee: The Gillette Company, Boston, Mass.

[21] Appl. No.: 844,190

[22] Filed: Oct. 21, 1977

[30] Foreign Application Priority Data

Oct. 30, 1976 [GB] United Kingdom ..... 45231/76

[51] Int. Cl.[2] ..... B26B 19/07

[52] U.S. Cl. ..... 30/43.92

[58] Field of Search ..... 30/43.91, 43.92

[56] References Cited

U.S. PATENT DOCUMENTS

| | | | |
|---|---|---|---|
| 2,841,867 | 7/1958 | Padgett | 30/43.92 X |
| 3,271,854 | 9/1966 | Starre | 30/43.92 X |
| 3,504,433 | 4/1970 | Futterer | 30/43.92 |
| 3,973,323 | 8/1976 | Trees | 30/43.92 |
| 4,038,749 | 8/1977 | Yamada | 30/43.92 |

FOREIGN PATENT DOCUMENTS 932904 7/1963 United Kingdom.

*Primary Examiner*—Gary L. Smith

*Attorney, Agent, or Firm*—Richard A. Wise; Donald E. Mahoney

[57] ABSTRACT

An electric dry shaver comprising a part-cylindrical cutting foil, an inner cutter provided with arcuate cutting edges which cooperate with said foil, and drive means to drive said inner cutter in linear reciprocation parallel to the axis of said part-cylindrical foil. The drive means includes a part-spherical driver head articulated to said inner cutter at a center of articulation substantially coincident with the center of gravity of said inner cutter and the center of application of the resultant of the frictional forces acting between said inner cutter and said foil during reciprocation of said inner cutter by said drive means is substantially coincident with said center of articulation and with said center of gravity.

7 Claims, 8 Drawing Figures

DRY SHAVERS

BACKGROUND OF THE INVENTION

This invention relates to dry shavers of the kind having an inner cutter adapted to be driven in linear reciprocation beneath a cutting foil by drive means including a driver articulated to the body of the inner cutter which carries the cutting blades cooperating with the foil.

In a dry shaver of the kind described, the cutting blades and the foil are biassed into engagement, usually by means of a spring acting on the cutter body along an axis through the center of gravity of the inner cutter perpendicular to the direction of reciprocation. In consequence, during operation of the shaver, frictional forces are developed between the foil and the inner cutter. These frictional forces vary in magnitude when the shaver is in use for shaving. However, the line of action thereof is found to be constant, and lies parallel to the direction of reciprocation. Moreover, the center of application of the resultant of these frictional forces is found to be fixed, and lies on the above-mentioned axis through the center of gravity of the cutter perpendicular to the direction of reciprocation. The present invention stems from an appreciation of the significance of these frictional forces in causing uneven wear and increasing power consumption, and in a consequent analysis of the magnitude and center of application of the resultant of the frictional forces.

In addition, in use of the shaver the inner cutter is subject to inertial forces of acceleration varying sinusoidally in known manner. The line of action of these inertial forces is also parallel to the direction of reciprocation, and the center of action of their resultant is at the center of gravity.

SUMMARY OF THE INVENTION

According to the present invention there is provided a dry shaver comprising a part-cylindrical cutting foil, an inner cutter provided with cutting edges which cooperate with said foil, drive means to drive said inner cutter in linear reciprocation parallel to the axis of said part-cylindrical foil, said drive means including a driver articulated to said inner cutter at a center of articulation substantially coincident with the center of gravity of said inner cutter, wherein the center of application of the resultant of the frictional forces acting between said inner cutter and said foil during reciprocation of said inner cutter by said drive means is substantially coincident with said center of articulation and said center of gravity.

Thus, in shavers according to the invention, the above-mentioned resultants of the frictional and inertial forces lie on a common axis extending parallel to the direction of reciprocation and passing through the center of articulation at which the driving force is applied. In consequence it is found that distortional torques on the inner cutter are substantially avoided. This has a number of advantages. First, the biassing force of the spring can be reduced, since the maximum bias required to handle distortional torques is minimized. This reduces overall wear and improves power consumption in the case of an electric shaver. Second, noise and vibration are reduced. Third, the normal tendency to maximum wear at the extremities of the foil is substantially avoided, and in general wear is both reduced and rendered more uniform.

In a practical construction of dry shaver in accordance with the invention, the articulation between the inner cutter and the driver comprises a part-spherical head formed on the driver, this part-spherical head being received in an undercut cylindrical recess in the inner cutter. Undesired disengagement of the cutter and the driver can thus be prevented.

BRIEF DESCRIPTION OF THE DRAWINGS

An embodiment of the invention will now be described, by way of example only, with reference to the accompanying drawings, in which.

DESCRIPTION OF PREFERRED EMBODIMENTS

Figure 1:
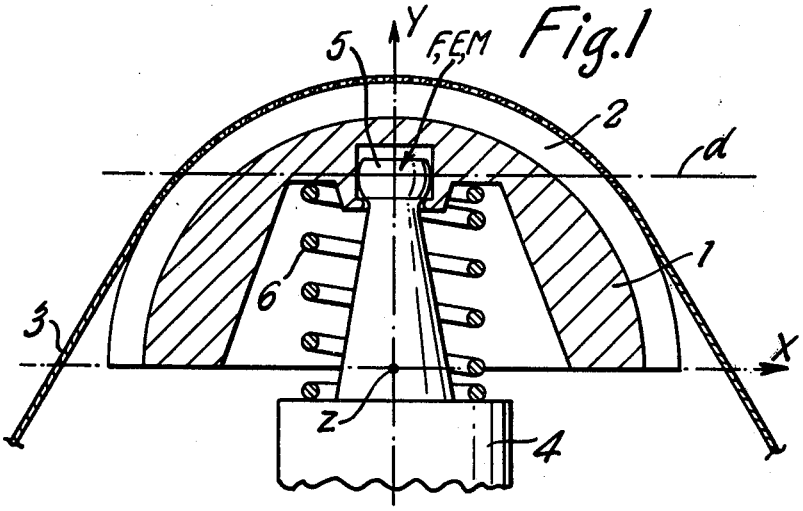
FIG. 1 shows a schematic transverse section through a cutting head of a dry shaver useful in explaining the invention.

The cutting head shown in FIG. 1 comprises an inner cutter having a cutter body 1 in which cutting blades 2 are rigidly fixed in plane parallel relationship substantially perpendicular to the intended axis of linear reciprocation Z. The blades have cutting edges conforming to a part-cylindrical surface centered on the axis Z, these cutting edges cooperating with a thin and flexible outer cutting foil 3 constrained to conform to said part cylindrical surface by means of a suitable foil frame (not shown), as is conventional in the art. The inner cutter is urged with predetermined force towards the foil, in use to establish a cutting action between the cutting edges of the blades 2 and the foil 3, by means of a spring 6 acting on the inner cutter body 1. This spring acts substantially along the axis Y, perpendicular to the axis of reciprocation Z.

The inner cutter is symmetrical about the plane containing the axes Y and Z, and therefore the center of gravity of the inner cutter lies on the axis Y. During operation, inertial forces due to accelerations and decelerations of the inner cutter in the direction of reciprocation are centered on the center of gravity and their resultant lies on an axis parallel to the direction of reciprocation. The afore-mentioned frictional forces which are develped between the inner cutter and the foil during operation are also centered on the axis Y, generally in the prior art at a point closer to the foil than the center of gravity, and their resultant also lies on an axis parallel to the direction of reciprocation.

The inner cutter is driven by a driver 4 itself driven by a motor (not shown), for example an electric motor to be powered from the mains or a battery. By means of an articulation 5 between the driver 4 and the inner cutter body 1, located on the axis Y, the inner cutter is reciprocated during operation. The driving force acting on the cutter also lies on an axis parallel to the direction of reciprocation. While affording a positive connection in the direction of the axis of reciprocation Z, the articulation 5 permits the cutter a limited freedom of displacement in the direction of the axis Y, and also affords freedom of rotation of the inner cutter around the axis d, and thus effectively around the parallel axis X, whereby to permit substantially perfect cooperation between the cutter edges and the foil, notwithstanding small dimensional and geometric errors in construction. In the shaver head shown in FIG. 1, the biassing spring 6 acts between the driver 4 and the inner cutter body 1, but alternative forms of biassing may be used.

Figure 2:
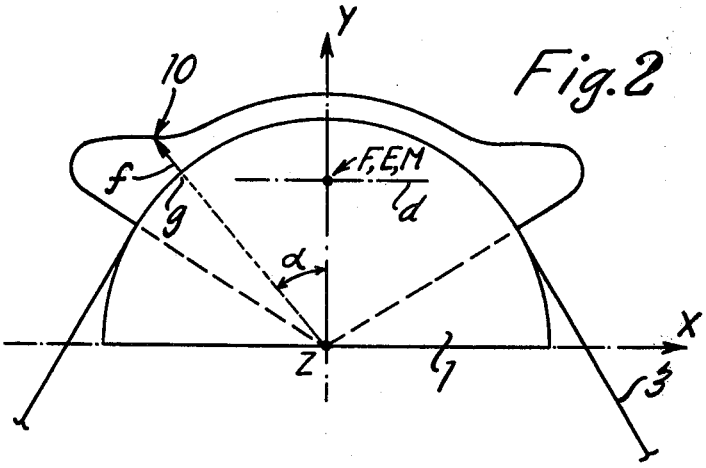
FIG. 2 is a diagram including a graph useful in locating point F.
Figure 3:
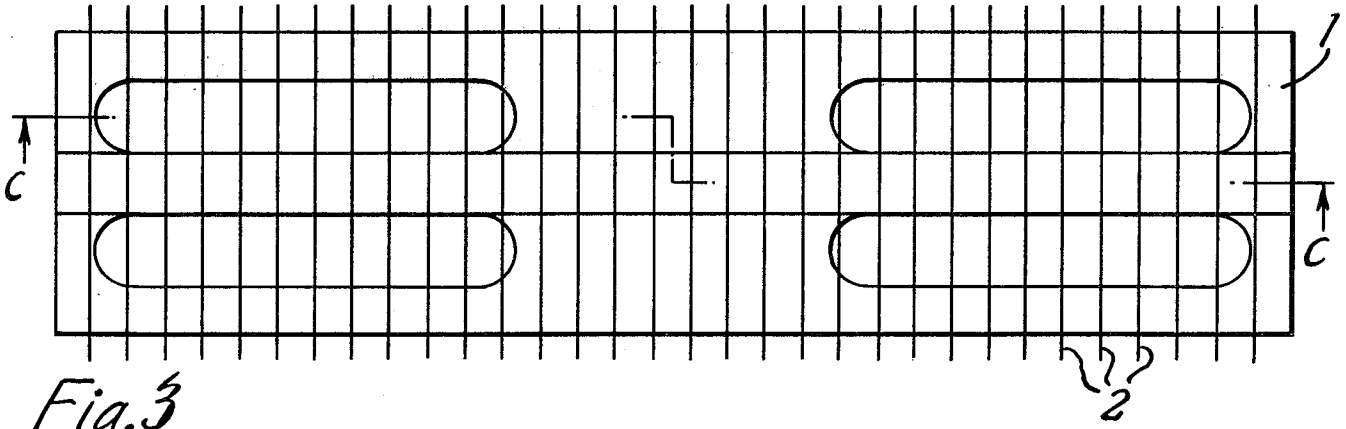
FIG. 3 is a top plan view of a practical embodiment of inner cutter for a shaver head.

The letter F may be used to designate the center of application of the resultant of the frictional forces, M designates the center of gravity of the inner cutter, also constituting the center of action of the resultant of the inertial forces, and E designates the point of articulation 5 between the driver 4 and the inner cutter body 1 also constituting the center of action of the driving force. In the shaver in accordance with the invention, these three points F, M and E are brought into substantial coincidence, as shown in FIGS. 1 and 2. This point is also the point of intersection of axes d and Y.

Referring now to FIG. 2 this shows a graph 10 representing the magnitude f of the frictional force, with respect to the angle $\alpha$, acting between the inner cutter 1 and the foil 3 along the generator of the contact g. As can be seen the graph is symmetrical about the Y axis. In view of the symmetry of construction of the cutter head, the graph is also symmetrical about axis Y when viewed in the Y-Z plane. The resultant of the frictional forces therefore cuts the axis Y parallel to the direction of reciprocation at the point F.

The point F is determined from graph 10 for a particular foil/cutter arrangement. In one embodiment the shape of the friction graph 10 was derived by theoretical analysis and then checked by evaluation of an extensive wear test on an actual foil/cutter assembly.

In a preferred design sequence the overall design of the foil and cutter blocks are settled and the point F then located as described above. The next step is to arrange for the center of gravity M of the inner cutter to coincide with the center of friction F, for example by adding or subtracting mass from the cutter design above or below the point F. The position of the center of gravity is dependent on shape, relative dimensions and chosen materials of the cutter. Finally the cutter block and drive pin are designed so that the center of articulation, which is the point of application E of the longitudinal drive force substantially coincides with the points F and M.

Figure 4:
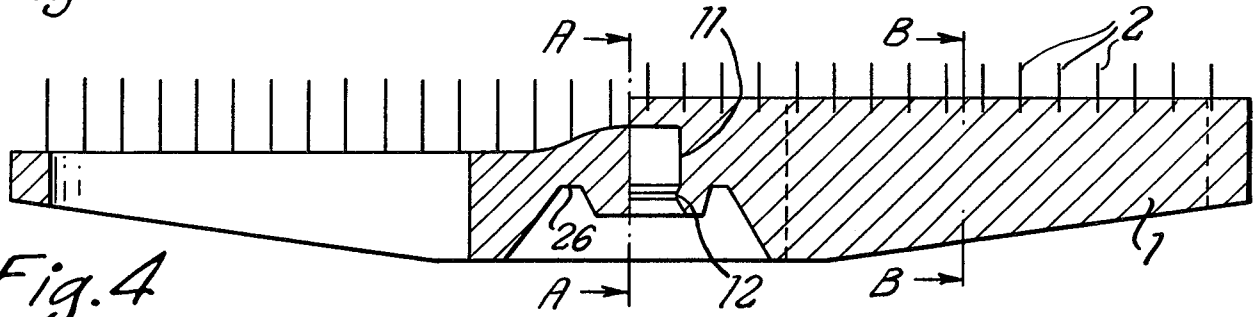
FIG. 4 is a section on line C—C of FIG. 3.
Figure 5:
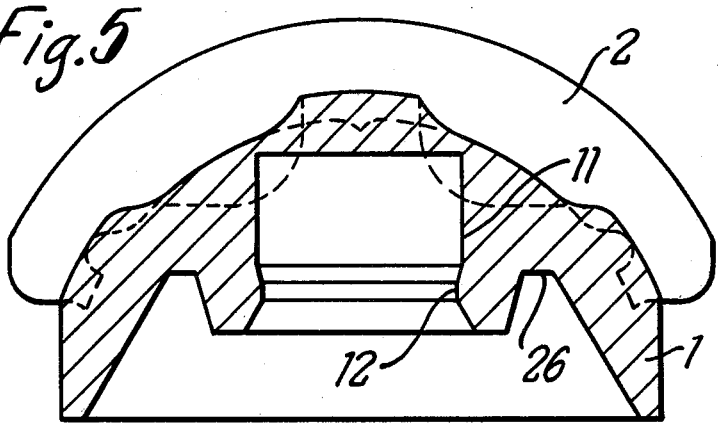
FIG. 5 is a section on line A—A of FIG. 4.
Figure 6:
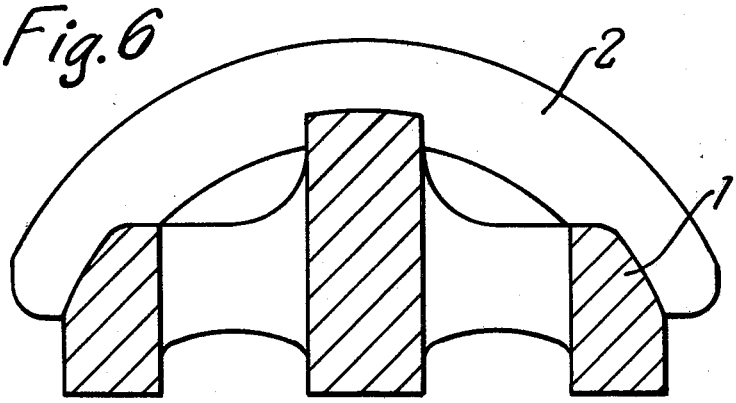
FIG. 6 is a section on line B—B of FIG. 4.
Figure 7:
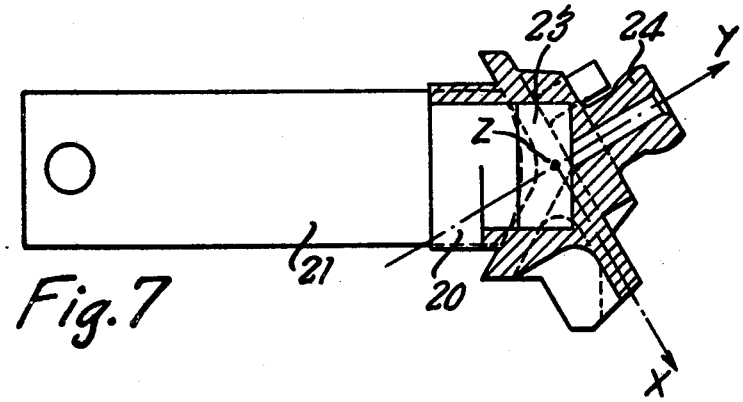
FIG. 7 is an end view of a practical form of drive assembly for the cutter of FIGS. 3–6.
Figure 8:
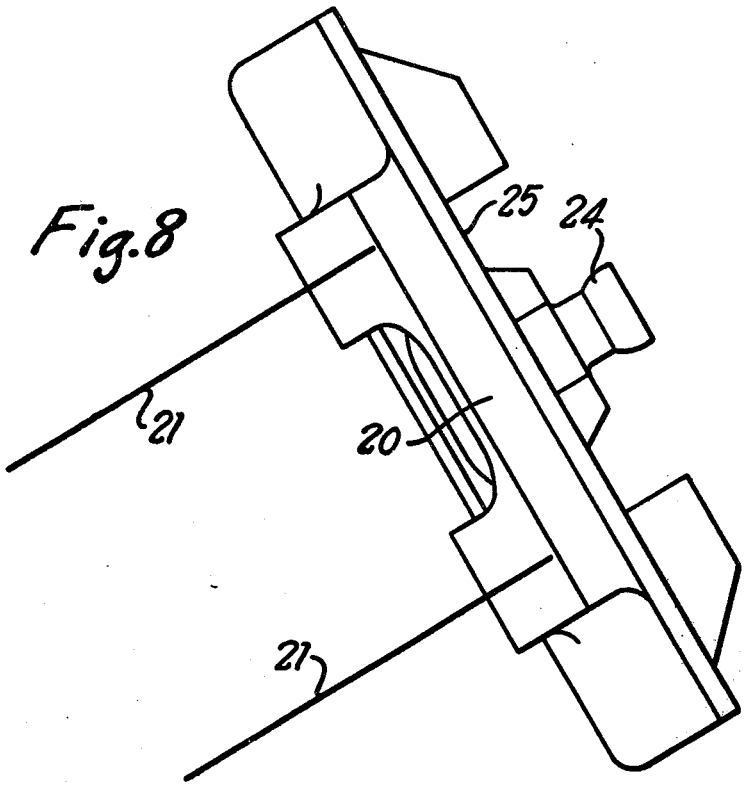
FIG. 8 is a view in the direction of line X of FIG. 7.

FIGS. 3 to 6 show a practical embodiment of inner cutter according to the invention in which points E, F and M are substantially coincident, and FIGS. 7 and 8 show a practical embodiment of drive assembly for driving the cutter of FIGS. 3 to 6. Similar reference numerals are used for similar parts from FIG. 1. The cutter body 1 is formed of polyacetal (density 1.4 grams per cc.). The cutter blades 2 are formed of steel (density 7.87 grams per cc.), and are moulded into the body 1 as shown in FIGS. 4 and 5. The cutter body is provided with a central cylindrical bore 11 as shown in FIGS. 4 and 5. The bore has an annular restriction 12 adjacent its entrance for a purpose to be explained.

The drive assembly of FIGS. 7 and 8 is similar in construction to the drive assembly described in detail in our copending Patent Application No. U.S. Ser. No. 791,648, with particular reference to FIGS. 2 and 3 thereof. Briefly, the assembly comprises a cutter support member 20 carried by a pair of spaced parallel leaf springs 21 secured at their lower ends to a shaver frame member by screws (not shown) through bores 22. The leaf springs 21 lie when unflexed in planes parallel to axes X and Y and perpendicular to axis Z. A drive slot 23 is formed in the underside of the member 20 and, in use, an electric motor driven eccentric drive pin (not shown) works within the slot 23. The eccentric pin describes circles within slot 23 to drive the member 20 in substantially longitudinal oscillation along axis Z, but constrained to a slightly curved path by flexing of the two leaf springs towards and away from their unflexed positions. The maximum extent of the deviation of the member 20, during its longitudinal oscillation, is 0.07 millimeters in the illustrated embodiment.

The cutter support member 20 has an upper surface inclined towards the front face of the shaver, in this embodiment by 30 degrees, for reasons fully explained in our above-cited copending Application. A part-spherical coupling head 24 rises centrally from the upper surface and works in the cylindrical bore 11 (FIG. 4). The coupling head 24 has to be forced into the bore past the restriction 12. This traps the cutter body to the cutter support member against the separating action of the spring 6 when the cutting head is removed for cleaning purposes. In the illustrated embodiment the spring 6 (not shown) acts between an annular seating surface 25 shown in FIG. 8 and an opposed annular seating surface in the annular recess 26 shown in FIGS. 4 and 5. The center of articulation E is the center of the part-spherical head 24. It will be appreciated that the substantially longitudinal oscillation of the cutter support member 20 drives the cutter body 1 in longitudinal oscillation by means of the head 24 received in the bore 11.

I claim:

1. A dry shaver comprising a part-cylindrical cutting foil, an inner cutter provided with cutting edges which cooperate with said foil, drive means to drive said inner cutter in linear reciprocation parallel to the axis of said part-cylindrical foil, said drive means including a driver articulated to said inner cutter at a center of articulation substantially coincident with the center of gravity of said inner cutter and the center of application of the resultant of the frictional forces acting between said inner cutter and said foil during reciprocation of said inner cutter by said drive means.

2. A dry shaver according to claim 1, wherein said inner cutter comprises a body of plastics material, said body carrying a plurality of spaced steel cutters providing said cutting edges.

3. A dry shaver according to claim 1, wherein said inner cutter is provided with a bore disposed substantially centrally of the length and width of said inner cutter, and said driver has a part-spherical head received in said bore.

4. A dry shaver according to claim 3 including a restriction adjacent the entrance to said bore, said restriction being dimensioned to permit said head to be forcibly entered into said bore whereby to trap the cutter to the driver.

5. A dry shaver according to claim 1 including compression spring means, said spring means located to bias said inner cutter into cutting cooperation with said foil.

6. A dry shaver according to claim 1 including a cutter support member, means securing said driver to said cutter support member, and said drive means including a drive member arranged to drive said cutter support member in substantially longitudinal oscillation.

7. A dry shaver according to claim 6 including a pair of spaced parallel leaf springs, first means securing each said leaf spring at one end to said cutter support member, second means securing each said leaf spring at the other end to a frame of said shaver, whereby to constrain said cutter support member to oscillate in a slightly curved path.

* * * * *